US009052635B2

(12) United States Patent
Ishii

(10) Patent No.: US 9,052,635 B2
(45) Date of Patent: Jun. 9, 2015

(54) IMAGE FORMING APPARATUS

(71) Applicant: OKI DATA CORPORATION, Tokyo (JP)

(72) Inventor: Takeshi Ishii, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/288,449

(22) Filed: May 28, 2014

(65) Prior Publication Data

US 2014/0356033 A1 Dec. 4, 2014

(30) Foreign Application Priority Data

May 31, 2013 (JP) ..... 2013-115518

(51) Int. Cl.
*G03G 15/08* (2006.01)

(52) U.S. Cl.
CPC ..... *G03G 15/0812* (2013.01)

(58) Field of Classification Search
CPC G03G 15/0812; G03G 15/095; G03G 13/095
USPC ..... 399/284
See application file for complete search history.

(56) References Cited

U.S. PATENT DOCUMENTS 5,126,800 A * 6/1992 Shishido et al. ..... 399/111
2011/0052273 A1* 3/2011 Kawano et al. ..... 399/281
2014/0037311 A1* 2/2014 Mitsunobu ..... 399/46

FOREIGN PATENT DOCUMENTS

JP 2009-134060 A 6/2009

* cited by examiner

*Primary Examiner* — Rodney Bonnette
(74) *Attorney, Agent, or Firm* — Kubotera & Associates, LLC

(57) ABSTRACT

An image forming apparatus includes a plurality of developing portions. Each of the developing portions includes a developer supporting member for supplying developer containing at least a binder resin to an image supporting member that supports a static latent image to develop the static latent image; and a layer regulating member arranged to contact with a surface of the developer supporting member and regulate a layer of developer. The image forming apparatus includes a first developing portion that uses first developer containing a metal oxide in the binder resin, and a second developing portion that uses second developer containing no metal oxide in the binder resin. The layer regulating member of the first developing portion is configured to apply a pressure to the developer supporting member smaller than that of the layer regulating member of the second developing portion applied to the developer supporting member.

14 Claims, 10 Drawing Sheets

| | White Toner | Other toner | Streak | Density |
|---|---|---|---|---|
| Comparative example 1 | Condition A | Condition A | Good | Poor |
| Comparative example 2 | Condition B | Condition B | Poor | Good |
| Embodiment | Condition A | Condition B | Good | Good |
| Comparative example 3 | Condition B | Condition A | Poor | Poor |

FIG. 6

| | Contact Area [$cm^2$] | Contact Pressure [$kgf/cm^2$] |
|---|---|---|
| Other toner (edge abutment) | 0.34 | 1.25 |
| White toner (middle abutment) | 0.51 | 0.63 |

FIG. 9

| | White Toner | Other toner | Streak | Density |
|---|---|---|---|---|
| Comparative example 4 | Condition C | Condition C | Poor | Good |
| Comparative example 5 | Condition D | Condition D | Good | Poor |
| Comparative example 6 | Condition C | Condition D | Poor | Poor |
| Embodiment | Condition D | Condition C | Good | Good |

FIG. 10

IMAGE FORMING APPARATUS

BACKGROUND OF THE INVENTION AND RELATED ART STATEMENT

The present invention relates to an image forming apparatus of an electro-photography type.

A conventional color image forming apparatus is configured to form a color image using a plurality of types of developer including developer in white color. The conventional color image forming apparatus includes a static latent image supporting member for supporting a static latent image; a charging unit for charging the static latent image supporting member; a developing device for developing the static latent image supported on the static latent image supporting member; and a transfer unit for transferring the static latent image thus developed to a medium.

In the conventional image forming apparatus, the developing device may include a developer supporting member and a layer regulating blade as a layer regulating member. The layer regulating blade is disposed on the developer supporting member. Accordingly, in the developing device, the layer regulating member regulates a layer thickness of a developer layer formed on the developer supporting member (refer to Patent Reference).

Patent Reference: Japanese Patent Publication No. 2009-134060

In the conventional image forming apparatus disclosed in Patent Reference, it may be difficult to properly form an image depending on type of toner to be used.

In view of the problems described above, an object of the present invention is to provide an image forming apparatus capable of properly forming an image.

Further objects and advantages of the invention will be apparent from the following description of the invention.

SUMMARY OF THE INVENTION

In order to attain the objects described above, according to an aspect of the present invention, an image forming apparatus includes a plurality of developing portions. Each of the developing portions includes a developer supporting member for supplying developer containing at least a binder resin to an image supporting member that supports a static latent image to develop the static latent image; and a layer regulating member arranged to contact with a surface of the developer supporting member and regulate a layer of developer.

Further, according to the aspect of the present invention, the image forming apparatus includes a first developing portion that uses first developer containing a metal oxide in the binder resin, and a second developing portion that uses second developer containing no metal oxide in the binder resin.

Further, according to the aspect of the present invention, the layer regulating member of the first developing portion is configured to apply a pressure to the developer supporting member smaller than that of the layer regulating member of the second developing portion applied to the developer supporting member.

In the image forming apparatus of the present invention, it is possible to reduce a possibility of improperly forming an image.

BRIEF DESCRIPTION OF THE DRAWINGS

FIG. 6 is a table showing an evaluation result of the image forming apparatus according to the first embodiment of the present invention;

FIG. 9 is a table showing a relationship between a contact area and a contact pressure of the developing blade of the image forming apparatus according to the second embodiment of the present invention; and FIG. 10 is a table showing an evaluation result of the image forming apparatus according to the second embodiment of the present invention.

DETAILED DESCRIPTION OF PREFERRED EMBODIMENTS

Hereunder, embodiments of the present invention will be explained with reference to the accompanying drawings. It should be noted that the present invention is not limited to the following description, and the embodiments can be modified within a scope of the present invention.

First Embodiment

Figure 1:
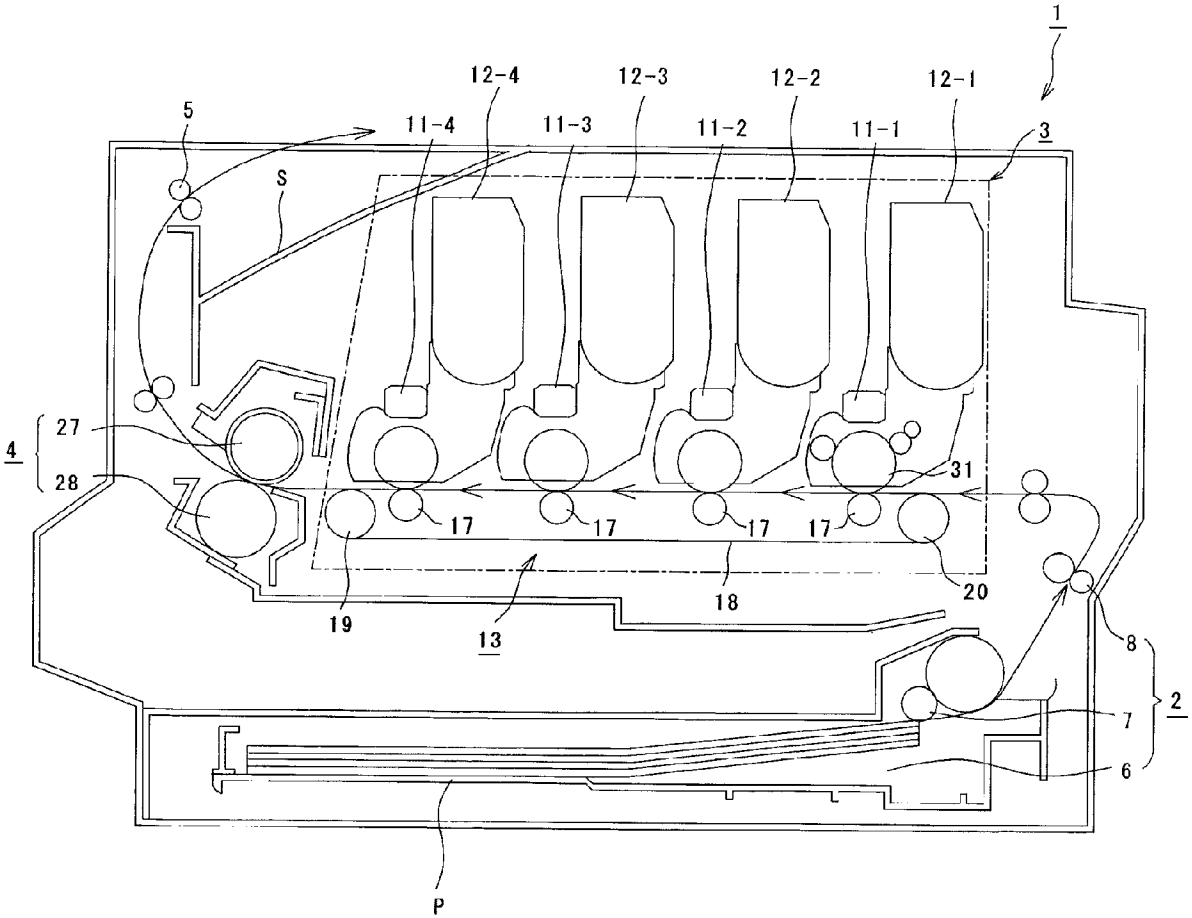
FIG. 1 is a schematic sectional view showing a configuration of an image forming apparatus according to a first embodiment of the present invention.

A first embodiment of the present invention will be explained. FIG. 1 is a schematic sectional view showing a configuration of a color printer 1 as an image forming apparatus according to the first embodiment of the present invention.

As shown in FIG. 1, the color printer 1 includes a medium supply unit 2; an image forming portion 3; a fixing unit 4; and a discharging member 5.

In the first embodiment, the medium supply unit 2 is disposed at a lower portion of the color printer 1. Further, the medium supply unit 2 includes a medium tray 6 as a medium storage portion, a hopping roller 7 as a sheet supplying member, and a transportation roller 8 as a transportation member.

The medium tray 6 is configured to store a sheet P as a printing medium in a stacked state. The hopping roller 7 is configured to pick up the sheet P stored in the medium tray 6 from the medium tray 6, and the transportation roller 8 is configured to transport the sheet P thus picked up to the image forming portion 3 that is a main component for forming an image.

In the first embodiment, the image forming portion 3 is disposed above the medium supply unit 2. Further, the image forming portion 3 includes exposure units 11-1, 11-2, 11-3, and 11-4; image drum units 12-1, 12-2, 12-3, and 12-4 as image forming units arranged to correspond to each of the exposure units 11-1, 11-2, 11-3, and 11-4; and a transfer belt unit 13, so that the image forming portion 3 is capable of performing a color printing operation in four colors. It should be noted that the exposure units 11-1, 11-2, 11-3, and 11-4 may be collectively referred to as exposure units 11, and the image drum units 12-1, 12-2, 12-3, and 12-4 may be collectively referred to as image drum units 12.

In the first embodiment, the exposure units 11 are arranged in an order of the exposure units 11-1, 11-2, 11-3, and 11-4 from an upstream side of a path through which the sheet P is transported, so that the exposure units 11 correspond to the image drum units 12. Further, the exposure units 11 are configured to remove charged electron charges in an image portion or a non-image portion through light irradiation, so that a static latent image is formed. Further, the exposure units 11 may be an LED (Light Emitting Diode) type using an LED head, a laser type using laser light, or the like. In the first embodiment, the exposure units 11 are the LED type.

In the first embodiment, the image drum units 12 are arranged in line over the transfer belt unit 13 in an order of the image drum units 12-1, 12-2, 12-3, and 12-4 from the upstream side of the path through which the sheet P is transported, so that the image drum units 12 store toner in different colors, respectively. It should be noted that, in the first embodiment, the image drum unit 12-1 stores white toner as developer in white color, and the image drum units 12-2, 12-3, and 12-4 store yellow toner, magenta toner, and cyan toner, respectively, as developer in other colors.

In the first embodiment, after the image drum units 12 develop toner images, the toner images are transferred to the sheet P on a transfer belt 18 (described later). A configuration of the image drum units 12 will be explained in more detail later. It should be noted that the image drum units 12-2, 12-3, and 12-4 may store toner in other color containing no metal oxide as developer in a color other than yellow, magenta, and cyan.

In the first embodiment, the transfer belt unit 13 includes transfer rollers 17 as a transfer member arranged to correspond to each of the image drum units 12; the transfer belt 18 as a medium supporting member; a belt drive roller 19; and a following roller 20 rotating together with the belt drive roller 19. The transfer rollers 17 are arranged to face a photosensitive drum 31 as an image supporting member disposed in each of the image drum units 12, and are configured to transfer the toner images developed on the photosensitive drums 31 to the sheet P. The transfer belt 18 is arranged to pass between each of the photosensitive drums 31 and each of the transfer rollers 17, so that the transfer belt 18 transports the sheet P. The belt drive roller 19 is provided as a drive unit for driving the transfer belt 18, and is arranged together with the following roller 20 to extend the transfer belt 18.

In the first embodiment, the fixing unit 4 includes a heating roller 27 and a pressing roller 28. The heating roller 27 is configured to transfer heat generated with a heating member to the sheet P. The pressing roller 28 is configured to apply a pressure to the sheet P together with the heating roller 27, so that the toner images are fixed to the sheet P.

After the toner images are fixed to the sheet P with the fixing unit 4, the discharging member 5 discharges the sheet P from the color printer 1 to a stacking portion S disposed at an upper portion of the color printer 1.

Figure 2:
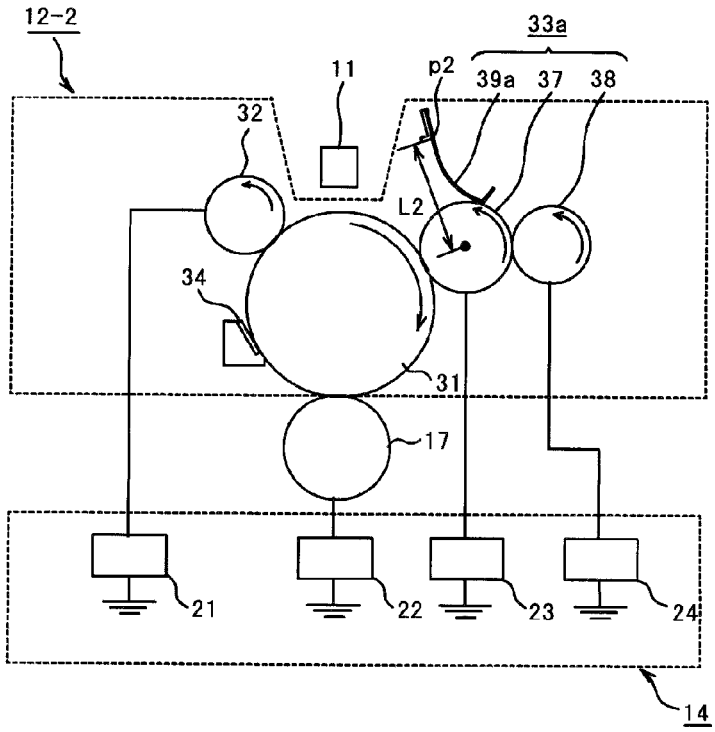
FIG. 2 is a schematic side view showing an exposure unit, an image drum unit, and a power source of the image forming apparatus when toner other than white toner is used according to the first embodiment of the present invention.

A configuration of the exposure units 11, the image drum units 12, and a power source when toner other than white toner is used will be explained next with reference to FIG. 2. FIG. 2 is a schematic side view showing the exposure unit 11, the image drum unit 12, and the power source of the image forming apparatus when toner other than white toner is used according to the first embodiment of the present invention. It should be noted that the image drum unit 12-2 is shown in FIG. 2.

As described above, in the color printer 1, the image drum units 12 retaining toner in different colors and the transfer rollers 17 are arranged at a plurality of locations to develop the toner images, so that the color printer 1 is capable of performing the color printing operation.

In the first embodiment, the image drum unit 12-2 retains yellow toner. As shown in FIG. 2, the image drum unit 12-2 includes the photosensitive drum 31 arranged to rotate in one direction. Further, along the rotational direction of the photosensitive drum 31, there are disposed a charging roller 32 as a charging unit for uniformly charging a surface of the photosensitive drum 31; a developing portion 33*a* for developing the static latent image formed on the surface of the photosensitive drum 31 with toner; and a cleaning member 34 for removing toner remaining on the surface of the photosensitive drum 31 after the toner image is transferred to the sheet P.

In the first embodiment, the photosensitive drum 31 is formed of an organic photosensitive member, and includes a conductive supporting member and a photosensitive layer disposed on a surface of the conductive supporting member. The conductive supporting member is formed of a metal pipe made of aluminum, and the photosensitive layer is formed of a lamination of an electron charge generation layer and an electron charge transportation layer. Further, the photosensitive drum 31 is arranged at a position to face the transfer roller 17, and is configured to support the static latent image. The charging roller 32 is formed of a metal shaft and a semi-conductive rubber layer, and is arranged to contact with the photosensitive drum 31. The cleaning member 34 includes a rubber elastic member such as a polyurethane rubber, and is arranged to abut against the photosensitive drum 31 with counter.

In the first embodiment, the developing portion 33*a* includes a developing roller 37 as a developer supporting member for developing the static latent image with toner; a supplying roller 38 as a supplying member for supplying toner to the developing roller 37; and a developing blade 39*a* as a layer regulating member for regulating a layer thickness of toner supplied to the developing roller 37. It should be noted that the developing blade 39*a* is collectively referred to as the developing blade 39, and the developing portion 33*a* is collectively referred to as the developing portion 33.

In the first embodiment, the developing roller 37 is formed of a metal shaft, a semi-conductive urethane rubber, and the like, and is arranged to abut against the photosensitive drum 31. The supplying roller 38 is formed of a metal shaft, a foamed silicone rubber, and the like, and is arranged to contact with the developing roller 37.

In the first embodiment, the charging roller 32, the transfer roller 17, the developing roller 37, and the supplying roller 38 are connected to a charging roller power source 21, a transfer roller power source 22, a developing roller power source 23, and a transfer roller power source 24 as voltage applying units, respectively. Accordingly, a bias is applied to each of the charging roller 32, the transfer roller 17, the developing roller 37, and the supplying roller 38. It should be noted that the charging roller power source 21, the transfer roller power source 22, the developing roller power source 23, and the transfer roller power source 24 are collectively referred to as the power source.

Figure 3A:
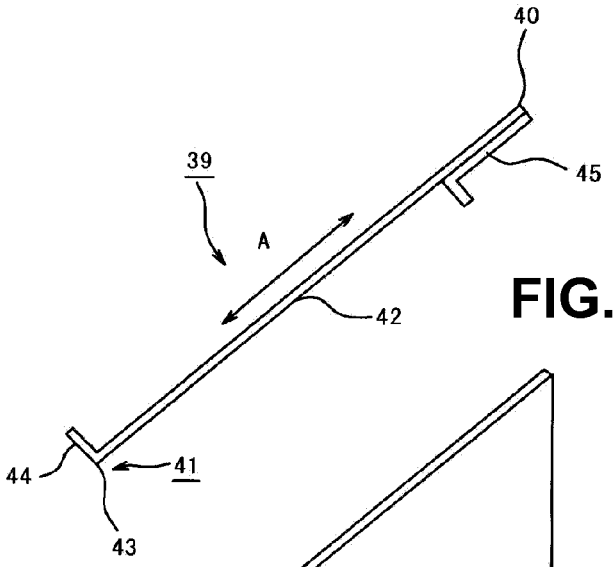
FIGS. 3(*a*) and 3(*b*) are schematic views showing a developing blade of the image forming apparatus according to the first embodiment of the present invention, wherein FIG. 3(*a*) is a schematic sectional view of the developing blade, and FIG. 3(*b*) is a schematic perspective view of the developing blade.
Figure 3B:
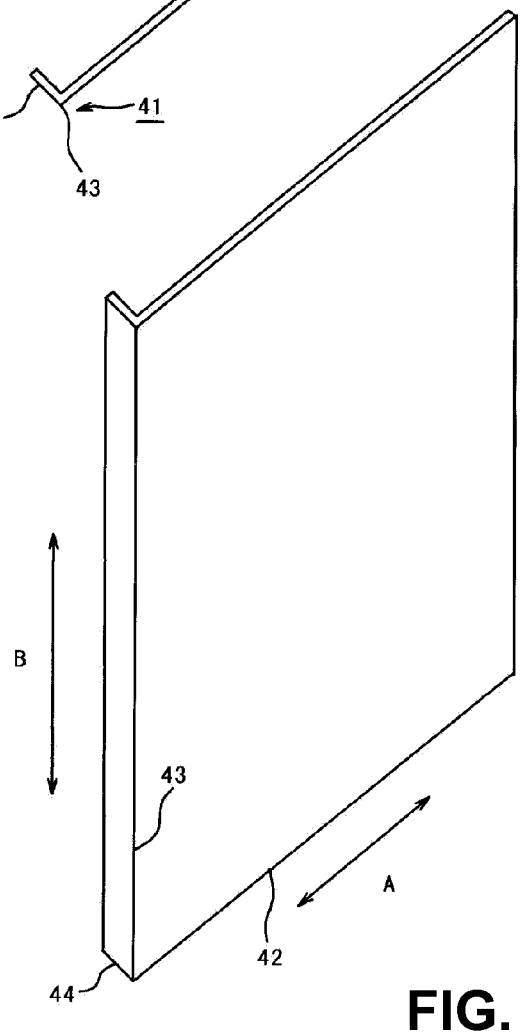

A configuration of the developing blade 39 will be explained next with reference to FIGS. 3(*a*) and 3(*b*). FIGS. 3(*a*) and 3(*b*) are schematic views showing the developing blade 39 of the image forming apparatus according to the first embodiment of the present invention. More specifically, FIG. 3(*a*) is a schematic sectional view of the developing blade 39, and FIG. 3(*b*) is a schematic perspective view of the developing blade 39. In FIGS. 3(*a*) and 3(*b*), an arrow A direction is defined as a longitudinal direction, and an arrow B direction is defined as a lateral direction.

As shown in FIG. 3(*a*), the developing blade 39 is formed of a metal plate having a substantially L character shape, i.e., a stainless steel plate in the first embodiment. A fixing end portion 40 is formed on one end portion of the developing blade 39 in the lateral direction, which is not curved in the L character shape, so that the developing blade 39 is fixed to an attachment member 45 that is disposed in the image drum unit 12. A free end portion 41 is formed on the other end portion of the developing blade 39, and is arranged to partially abut against the developing roller 37.

In the first embodiment, the developing blade 39 includes a bending portion 42 formed between the fixing end portion 40 and the free end portion 41, an edge portion 43 formed in a bent shape, and a bent piece 44 extending toward a distal end portion from the edge portion 43. It is configured such that the bending portion 42 has a length of 17 mm in the lateral direction, the edge portion 43 is bent at an angle of 90 degrees with a curvature radius of 0.3 mm, and the bent piece 44 has a length of 1.4 mm.

An operation of the image drum unit 12 will be explained next with reference to FIG. 2.

As described above, the photosensitive drum 31 is arranged to contact with the charging roller 32 connected to the charging roller power source 21, so that the charging roller 32 uniformly charges the surface of the photosensitive drum 31 when the power is turned on. At this moment, the surface of the photosensitive drum 31 has a charge potential of about −600 V.

Then, the exposure unit 11 irradiates light on the photosensitive drum 31 at an exposure location according to an image signal. As a result, electron charges are transported to form the static latent image on the surface of the photosensitive drum 31. At this moment, the surface of the photosensitive drum 31, where the static latent image is formed, has the charge potential of about −50 V.

Further, the supplying roller 38 is arranged to abut against the developing roller 37, so that the supplying roller 38 charges toner. At the same time, the supplying roller 38 is rotated together with the developing roller 37 while maintaining a constant circumferential speed ratio relative to the developing roller 37, so that the supplying roller 38 supplies toner to the developing roller 37. More specifically, the developing roller 37 is rotated at a circumferential speed of 202 mm/sec, and the supplying roller 38 is rotated at a circumferential speed of 140 mm/sec. Accordingly, the circumferential speed ratio becomes about 1:0.7. As described above, the supplying roller 38 is connected to the transfer roller power source 24 such that a supply potential of the supplying roller 38 is about between −350 and −400 V.

When the supplying roller 38 supplies toner to the developing roller 37, toner is accumulated on the developing roller 37 in a layered shape. As described above, the developing roller 37 is connected to the developing roller power source 23, so that the developing roller 37 is maintained at about −200 V. Further, the developing roller 37 is rotated to transport toner. The developing blade 39 is arranged to abut against the developing roller 37 while the developing roller 37 is supporting toner and being rotated toward the photosensitive drum 31. Accordingly, the developing blade 39 makes toner on the developing roller 37 a thin layer, and charges toner through friction and the like.

In the first embodiment, on the surface where the developing roller 37 abuts against the photosensitive drum 31, toner thus charged is moved toward the photosensitive drum 31 due to the potential difference in an area on the photosensitive drum 31 where the static latent image is formed, thereby developing the static latent image. On the other hand, toner is not moved toward the photosensitive drum 31 in an area on the photosensitive drum 31 where the static latent image is not formed, so that toner remains attached to the developing roller 37 in the layered shape. When the developing roller 37 is rotated further, toner remaining attached to the developing roller 37 is moved toward the supplying roller 38. Afterward, toner thus moved and toner freshly supplied from the supplying roller 38 are accumulated together on the developing roller 37 once again.

After the developing roller 37 forms the toner image on the photosensitive drum 31, the photosensitive drum 31 keeps rotating, and the transfer belt unit 13 transfers the toner image to the sheet P. After the toner image is transferred to the sheet P, and the photosensitive drum 31 keeps rotating, the toner image approaches a counter location where the cleaning member 34 abuts against the photosensitive drum 31 with counter. AT the counter location, the cleaning member 34 scraps off toner not transferred and remaining on the photosensitive drum 31, so that toner is removed from the photosensitive drum 31.

Afterward, the photosensitive drum 31 keeps rotating, and the photosensitive drum 31 is charged at the contact surface relative to the charging roller 32. The printing operation described above is repeated until the printing operation is completed.

In the first embodiment, toner is formed of toner base particles, and an outer additive agent (for example, a charge regulating agent, an anti-oxidant agent, and the like) is added to the toner base particles. The toner base particles are produced through mixing and coagulating an adhesive resin as a binder resin (for example, a polyester type resin, a styrene-acryl-copolymer resin, and the like), a colorant agent, and a wax. Toner has a particle size of 5 to 9 μm.

In the first embodiment, the colorant agent for toner in yellow, magenta, and cyan may include an agent other than a metal oxide such as, for example, carbon black, phthalocyanine blue, permanent brown FG, brilliant fast scarlet, pigment green B, Rhodamine lake, quinacridone, carmine 6B, dis-azo yellow, and the like. The colorant agent is contained at 2 to 20 weight parts relative to 100 weight parts of the binder resin.

On the other hand, the colorant agent for white toner may generally include an inorganic material, for example, a metal oxide such as titanium oxide, zinc oxide, and aluminum oxide. In the first embodiment, titanium oxide is used as the colorant agent of white toner. When titanium oxide with good masking property is used as the colorant agent, titanium oxide is contained at 25 to 35 weight parts relative to 100 weight parts of the binder resin, thereby improving the masking property. It should be noted that white toner using the inorganic material as the colorant agent tends to have a large specific gravity and a higher content as opposed to toner in other colors (yellow, magenta, and cyan). As a result, white toner is 1.6 to 2 times heavier than toner in other colors.

In the first embodiment, white toner is used as first developer formed of the binder resin containing metal oxide, and toner in other colors is used as second developer formed of the binder resin containing no metal oxide. Further, it should be noted that the image drum unit using white toner is defined as a first developing portion using the first developer, and the image drum unit using toner other than white toner is defined as a second developing portion using the second developer.

Figure 4:
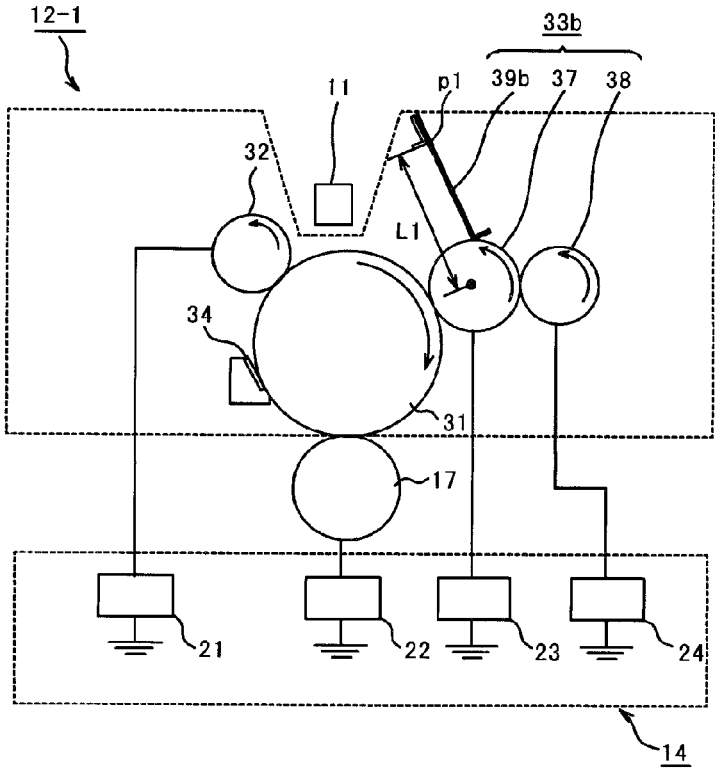
FIG. 4 is a schematic side view showing the exposure unit, the image drum unit, and the power source of the image forming apparatus when white toner is used according to the first embodiment of the present invention.
Figure 5:
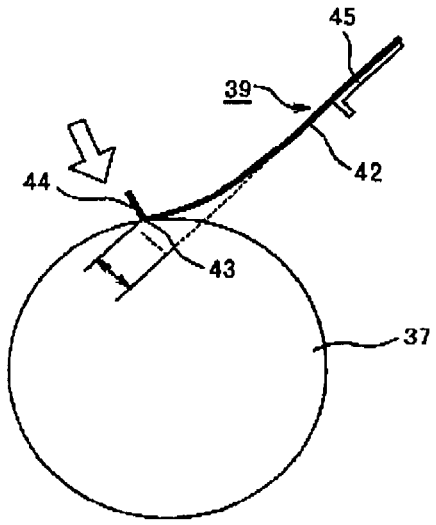
FIG. 5 is a schematic side view showing a developing roller and the developing blade of the image forming apparatus according to the first embodiment of the present invention.

A characteristic of the image drum unit 12 disposed in the color printer 1 will be explained next with reference to FIGS. 2, 4, and 5. FIG. 4 is a schematic side view showing the exposure unit 11, the image drum unit 12-1, and the power source of the image forming apparatus when white toner is used according to the first embodiment of the present invention. FIG. 5 is a schematic side view showing the developing roller 37 and the developing blade 39 of the image forming apparatus according to the first embodiment of the present invention.

It should be noted that the image drum unit 12-1 using white toner shown in FIG. 4 has a configuration different from that of the image drum unit 12-2 using toner other than white toner shown in FIG. 2. More specifically, the developing blade 39 is attached to different locations in the configurations shown in FIGS. 2 and 4. In order to explicitly show the difference, FIG. 2 shows the developing blade 39*a* and the developing portion 33*a*, and FIG. 4 shows the developing blade 39*b* and the developing portion 33*b*.

In the first embodiment, in the image drum unit 12-1 retaining white toner shown in FIG. 4, as opposed to the image drum unit 12-2 retaining toner other than white toner shown in FIG. 2, it is configured such that a linear pressure of the developing blade 39*b* applied to the developing roller 37 becomes smaller.

As described above, the developing blade 39*a* or 39*b* is arranged to abut against the developing roller 37 at the edge portion 43. Accordingly, the contact portion between the developing blade 39*a* or 39*b* and the developing roller 37 has a same width between the image drum units 12-1 and 12-2. A pressure or a contact pressure of the developing blade 39*a* or 39*b* against the developing roller 37 is obtained by dividing the liner pressure by the width of the contact portion. Accordingly, when the liner pressure becomes smaller, the contact pressure becomes smaller as well.

As shown in FIG. 5, a deformation amount is defined as a distance between a position of the edge portion 43 before the developing blade 39 contacts with the developing roller 37 and a position of the edge portion 43 after the developing blade 39 contacts with the developing roller 37. When the deformation amount increases, the contact pressure of the developing blade 39 applied to the developing roller 37 increases. Accordingly, it is possible to determine the contact pressure of the developing blade 39 applied to the developing roller 37 according to the deformation amount.

In the first embodiment, the developing roller 37 of the developing portion 33*a* is formed of a material the same as that of the developing roller 37 of the developing portion 33*b*. Further, the developing blade 39*a* is formed of a material the same as, and has a size the same as those of the developing blade 39*b*. In the image drum units 12-1 and 12-2, the developing blade 39*a* or 39*b* is arranged to contact with the developing roller 37 at the same location, and the developing blade 39*a* is attached at an attachment location p1 different from an attachment location p2 of the developing blade 39*b*. Accordingly, a distance between a center point of the developing roller 37 and the attachment location p1 or p2 of the developing blade 39*a* or 39*b* corresponds to a distance between the contact portion between the developing roller 37 and the developing blade 39*a* or 39*b* and the attachment location p1 or p2 of the developing blade 39*a* or 39*b*.

As shown in FIG. 4, in the image drum unit 12-1 retaining white toner, a distance L1 between the center point of the developing roller 37 and the attachment location p1 of the developing blade 39*b* is set to 30 mm. As shown in FIG. 5, in the image drum unit 12-2 retaining toner other than white toner, a distance L2 between the center point of the developing roller 37 and the attachment location p2 of the developing blade 39*a* is set to 25 mm. Accordingly, the distance L1 is greater than the distance L2 (L1>L2). As described above, the developing roller 37 and the developing blade 39 are formed of the same materials in the image drum units 12-1 and 12-2. Accordingly, the developing blade 39*b* is deformed in the deformation amount smaller than that of the developing blade 39*a*. More specifically, the attachment location p1 of the developing blade 39*b* is located further from the center point of the developing roller 37 by 5 mm than the attachment location p2 of the developing blade 39*a*. Accordingly, it is possible to reduce the liner pressure of the developing blade 39*b* applied to the developing roller 37 smaller than that of the developing blade 39*a* applied to the developing roller 37.

In an actual example, in the image drum unit 12-2 using toner other than white toner, the linear pressure of the developing blade 39*a* exhibited 15.5 gf/cm. In the image drum unit 12-1 using white toner, the linear pressure of the developing blade 39*b* exhibited 10.9 gf/cm. If the image drum unit 12-2 uses white toner, when the linear pressure decreased, it was found that the charge amount of toner decreased, thereby making the layer thickness of toner unstable. As described above, the linear pressure is defined as the pressure of the developing blade 39 applied to the developing roller 37 per unit length.

An experiment for evaluating the developing portions 33*a* and 33*b* will be explained next. In the experiment, the developing portion 33*a* used toner other than white toner and the developing portion 33*b* used white toner. Further, the attachment locations p1 and p2 of the developing blades 39*a* and 39*b* were adjusted, and the printing operation was performed. After the printing operation was performed, a printed sheet was observed to determine whether a streak or a band (streak and band) was generated, and an image density was measured.

FIG. 6 is a table showing an evaluation result of the image forming apparatus according to the first embodiment of the present invention.

In the experiment, the color printer 1 performed the printing operation on the sheet P with A4 size in the number of 20,000, so that a pattern with an intermediate gradation and a pattern with 100% density were printed on each of the sheets P. After the printing operation was performed, the printed sheets were observed to determine whether the streak and band was generated, and the image density was evaluated.

In the experiment, when the streak and band having a width greater than 1 mm was visible, an evaluation result of the streak and band was determined to be poor. When the streak and band having a width greater than 1 mm was not visible, the evaluation result of the streak and band was determined to be good. The image density was measured using a density measurement device X-Rite 528 (a product of X-Rite, Inc.) When the image density was equal to or smaller than 1.3 or equal to or greater than 1.7, an evaluation result of the image density was determined to be poor. When the image density was greater than 1.3 and smaller than 1.7, the evaluation result of the image density was determined to be good.

In the experiment, a condition A was defined as that the attachment location was p1 and the linear pressure became 10.9 gf/cm, and a condition B was defined as that the attachment location was p2 and the linear pressure became 15.5 gf/cm.

As shown in FIG. 6, in the first embodiment, the condition A was applied to the developing portion 33*b* using white toner, and the condition B was applied to the developing portion 33*a* using toner in yellow, cyan, and magenta. In comparison, in Comparative Example No. 1, the condition A was applied to the developing portion 33*b* using white toner and the developing portion 33*a* using toner in yellow, cyan, and magenta. In Comparative Example No. 2, the condition B was applied to the developing portion 33*b* using white toner and the developing portion 33*a* using toner in yellow, cyan, and magenta. In Comparative Example No. 3, the condition B was applied to the developing portion 33*b* using white toner, and the condition A was applied to the developing portion 33*a* using toner in yellow, cyan, and magenta.

As shown in the evaluation results in FIG. 6, in the first embodiment, the streak and band and the image density were both determined to be good. In comparison, in Comparative Example No. 1, the streak and band was determined to be good, and the image density was determined to be poor. In Comparative Example No. 2, the streak and band was determined to be poor, and the image density was determined to be good. In Comparative Example No. 3, the streak and band and the image density were both determined to be poor.

In the experiment, it was found that when the condition A was applied to the developing portion 33*a* using toner in yellow, cyan, and magenta, the image density was determined to be poor. This is because the contact pressure between the developing blade 39*a* and the developing roller 37 became too small, and it was difficult to obtain a sufficient image density in the printing operation. Further, it was found that when the condition B was applied to the developing portion 33*b* using white toner, the streak and band was determined to be poor. This is because white toner contains a large amount of hard colorant agent such as titanium oxide. As a result, the hard toner particles were rubbed against the developing blade 39*b*, so that the developing blade 39*b* tends to be damaged and worn out more easily.

As shown in FIG. 6, in the first embodiment, the condition A is applied to the developing portion 33*b* using white toner, and the condition B is applied to the developing portion 33*a* using toner in yellow, cyan, and magenta. Accordingly, it is possible to obtain the image with good quality.

As described above, in the first embodiment, in the developing portion 33*b* using white toner, the liner pressure of the developing blade 39*b* is recued. Accordingly, it is possible to supper the image quality problem. It should be noted that, in order to obtain the effect, the developing blade 39 may be configured to abut against the developing roller 37 in a different configuration other than that the edge portion 43.

It should be noted that, when the liner pressure of the developing blade 39*b* against the developing roller 37 is recued, the charge amount of toner tends to be reduced. As a result, it may be possible that an ability of reproducing the static latent image, that is, the dot reproducibility, may be deteriorated. However, when white toner is used, the dot reproducibility tends to be less significant. More specifically, when white toner is used, a white toner image is applied to a medium in a color such as a color sheet or a black sheet, or a medium such as a transparent material, that is, white toner is uniformly applied to a base of the medium, thereby forming a blocking layer. Afterward, a color image is formed on the blocking layer, so that an influence of the base color is minimized and a color property is improved. Accordingly, when white toner is used, the dot reproducibility is not strictly required and tends to be less significant as opposed to toner in other colors.

As described above, in the first embodiment, in the image drum unit 12-1 using white toner, the attachment location p1 of the developing blade 39*b* is properly adjusted, thereby reducing the linear pressure of the developing blade 39*b*. Accordingly, it is possible to prevent the developing blade 39*b* from being worn out excessively, thereby making it possible to obtain the image with high quality.

Second Embodiment

A second embodiment of the present invention will be explained next. In the second embodiment, the color printer 1 has a configuration similar to that in the first embodiment, and an explanation thereof is omitted.

Figure 7:
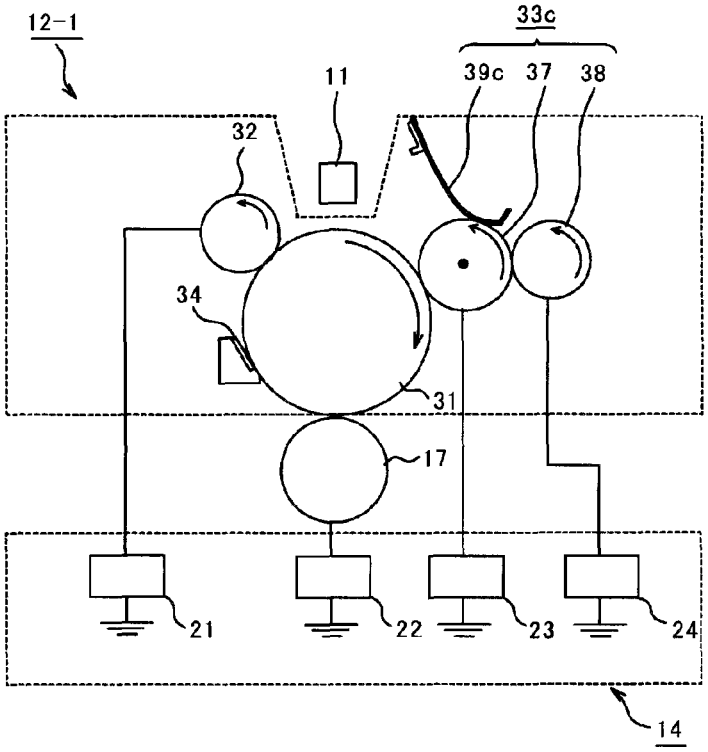
FIG. 7 is a schematic side view showing an exposure unit, an image drum unit, and a power source of an image forming apparatus when toner other than white toner is used according to a second embodiment of the present invention.

FIG. 7 is a schematic side view showing an exposure unit, an image drum unit, and a power source of an image forming apparatus when toner other than white toner is used according to the second embodiment of the present invention. It should be noted that, in the second embodiment, the image drum unit 12-1 using white toner is illustrated in FIG. 7, and the image drum unit 12-2 using toner other than white toner is illustrated in FIG. 2.

As shown in FIG. 7, the image drum unit 12-1 includes the photosensitive drum 31, the charging roller 32, the cleaning member 34, and a developing portion 33*c* for developing the static latent image formed on the surface of the photosensitive drum 31 using toner. The developing portion 33*c* includes the developing roller 37, the supplying roller 38, and a developing blade 39*c* as a layer regulating member for regulating a layer thickness of toner supplied to the developing roller 37.

Figure 8A:
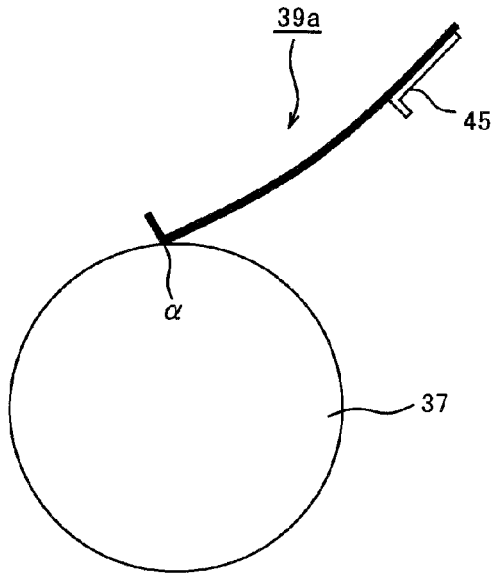
FIGS. 8(*a*) and 8(*b*) are schematic side views showing a developing roller and a developing blade of the image forming apparatus according to the second embodiment of the present invention, wherein FIG. 8(*a*) is a schematic side view showing the developing roller and the developing blade of the image forming apparatus when toner other than white toner is used, and FIG. 8(*b*) is a schematic side view showing the developing roller and the developing blade of the image forming apparatus when white toner is used.
Figure 8B:
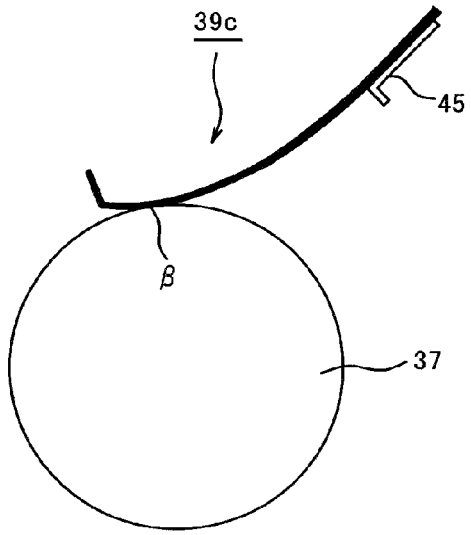

FIGS. 8(*a*) and 8(*b*) are schematic side views showing the developing roller 37 and the developing blade 39 of the image forming apparatus according to the second embodiment of the present invention. More specifically, FIG. 8(*a*) is a schematic side view showing the developing roller 37 and the developing blade 39*a* of the image forming apparatus when toner other than white toner is used, and FIG. 8(*b*) is a schematic side view showing the developing roller 37 and the developing blade 39*c* of the image forming apparatus when white toner is used.

As shown in FIG. 8(*a*), when toner other than white toner is used, similar to the first embodiment, the developing blade 39*a* is arranged such that the edge portion 43 thereof contacts with the developing roller 37, that is, the edge contact (a contact surface α). As shown in FIG. 8(*b*), when white toner is used, similar to the first embodiment, the developing blade 39*c* is arranged such that the bending portion 42 thereof contacts with the developing roller 37, that is, the middle contact (a contact surface N. In the second embodiment, the developing blade 39*c* is curved in an L character shape, and may be formed in a flat plate without curving such that the middle of the flat plate contacts with the developing roller 37.

With the configuration described above, it is possible to adjust the contact pressure between the developing blade 39 and the developing roller 37 through adjusting the side of the contact area between the developing blade 39 and the developing roller 37.

FIG. 9 is a table showing a relationship between the contact area and the contact pressure of the developing blade 39 of the image forming apparatus according to the second embodiment of the present invention.

As shown in FIG. 9, when toner other than white toner is used, the contact area between the developing blade 39*a* and the developing roller 37 becomes 0.34 $cm^2$, and the developing blade 39*a* applies the contact pressure of 1.25 $kgf/cm^2$ to the developing roller 37. When white toner is used, the contact area between the developing blade 39*c* and the developing roller 37 becomes 0.51 $cm^2$, and the developing blade 39*a* applies the contact pressure of 0.63 $kgf/cm^2$ to the developing roller 37.

In general, when the developing blade 39 applies the same force to the developing roller 37, the contact pressure is inversely proportional to the contact area. Accordingly, when the contact surface α has the contact area two-third of that of the contact surface β, the contact pressure using toner other than white toner becomes 1.5 times of the contact pressure using white toner.

An experiment for evaluating the developing portions 33*a* and 33*c* will be explained next. In the experiment, the developing portion 33*a* used toner other than white toner and the developing portion 33*c* used white toner. Further, the attachment locations p1 and p2 of the developing blades 39*a* and 39*c* were adjusted, and the printing operation was performed. After the printing operation was performed, a printed sheet was observed to determine whether the streak and band was generated, and the image density was measured.

FIG. 10 is a table showing an evaluation result of the image forming apparatus according to the second embodiment of the present invention.

In the experiment, the color printer 1 performed the printing operation on the sheet P with A4 size in the number of 20,000, so that the pattern with an intermediate gradation and the pattern with 100% density were printed on each of the sheets P. After the printing operation was performed, the printed sheets were observed to determine whether the streak and band was generated, and the image density was evaluated.

In the experiment, when the streak and band having the width greater than 1 mm was visible, the evaluation result of the streak and band was determined to be poor. When the streak and band having the width greater than 1 mm was not visible, the evaluation result of the streak and band was determined to be good. The image density was measured using the density measurement device X-Rite 528 (a product of X-Rite, Inc.) When the image density was equal to or smaller than 1.3 or equal to or greater than 1.7, the evaluation result of the image density was determined to be poor. When the image density was greater than 1.3 and smaller than 1.7, the evaluation result of the image density was determined to be good.

In the experiment, a condition C was defined as that the contact area between the developing blade 39 and the developing roller 37 was 0.34 $cm^2$, and the developing blade 39 applied the contact pressure of 1.25 $kgf/cm^2$ to the developing roller 37. A condition D was defined as that the developing blade 39 and the developing roller 37 was 0.51 $cm^2$, and the developing blade 39 applied the contact pressure of 0.63 $kgf/cm^2$ to the developing roller 37.

As shown in FIG. 10, in the second embodiment, the condition D was applied to the developing portion 33*c* using white toner, and the condition C was applied to the developing portion 33*a* using toner in yellow, cyan, and magenta. In comparison, in Comparative Example No. 4, the condition C was applied to the developing portion 33*c* using white toner and the developing portion 33*a* using toner in yellow, cyan, and magenta. In Comparative Example No. 5, the condition D was applied to the developing portion 33*c* using white toner and the developing portion 33*a* using toner in yellow, cyan, and magenta. In Comparative Example No. 6, the condition C was applied to the developing portion 33*c* using white toner, and the condition D was applied to the developing portion 33*a* using toner in yellow, cyan, and magenta.

As shown in the evaluation results in FIG. 10, in the second embodiment, the streak and band and the image density were both determined to be good. In comparison, in Comparative Example No. 4, the streak and band was determined to be poor, and the image density was determined to be good. In Comparative Example No. 5, the streak and band was determined to be good, and the image density was determined to be poor. In Comparative Example No. 6, the streak and band and the image density were both determined to be poor.

In the experiment, it was found that when the condition D was applied to the developing portion 33*a* using toner in yellow, cyan, and magenta, the image density was determined to be poor. This is because the contact pressure between the developing blade 39*a* and the developing roller 37 became too small, and it was difficult to obtain a sufficient image density in the printing operation. Further, it was found that when the condition C was applied to the developing portion 33*c* using white toner, the streak and band was determined to be poor. This is because white toner contains a large amount of hard colorant agent such as titanium oxide. As a result, the hard toner particles were rubbed against the developing blade 39*c*, so that the developing blade 39*c* tends to be damaged and worn out more easily.

As shown in FIG. 10, in the second embodiment, the condition D is applied to the developing portion 33*c* using white toner, and the condition C is applied to the developing portion 33*a* using toner in yellow, cyan, and magenta. Accordingly, it is possible to obtain the image with good quality.

In the second embodiment, in the image drum unit 12-1 using white toner, it may be configured such that the contact area between the developing blade 39*c* and the developing roller 37 is increased to reduce the contact pressure, thereby obtaining an image with good quality. However, similar to the first embodiment, when the contact pressure between the developing blade 39*c* and the developing roller 37 is reduced, the charge amount of toner tends to be reduced, thereby deteriorating the dot reproducibility.

In the second embodiment, similar to the first embodiment, when white toner is used, the dot reproducibility tends to be less significant. More specifically, when white toner is used, a white toner image is applied to a medium in a color such as a color sheet or a black sheet, or a medium such as a transparent material, that is, white toner is uniformly applied to a base of the medium, thereby forming a blocking layer. Afterward, a color image is formed on the blocking layer, so that an influence of the base color is minimized and a color property is improved. Accordingly, when white toner is used, the dot reproducibility is not strictly required and tends to be less significant as opposed to toner in other colors.

As described above, in the second embodiment, in the developing portion 39*c* using white toner, the contact area between the developing blade 39*c* and the developing roller 37 is increased, thereby reducing the contact pressure of the developing blade 39*c*. Accordingly, it is possible to prevent the developing blade 39*c* from being worn out excessively, thereby making it possible to obtain the image with high quality.

In the first and second embodiments, the developing portion 33*b* or 33*c* uses white toner, and the present invention is not limited to white toner. Alternatively, the present invention may be applicable to black magnetic toner formed of iron oxide (ferrite). In this case, it is possible to prevent the developing blade 39 from being worn out excessively, thereby making it possible to obtain the image with high quality.

The disclosure of Japanese Patent Application No. 2013-115518, filed on May 31, 2013, is incorporated in the application.

While the invention has been explained with reference to the specific embodiments of the invention, the explanation is illustrative and the invention is limited only by the appended claims.

What is claimed is:

1. An image forming apparatus, comprising:

a first developing portion retaining first developer containing a metal oxide in a first binder resin thereof; and a second developing portion retaining second developer containing no metal oxide in a second binder resin thereof, wherein said first developing portion includes a first developer supporting member for supplying the first developer to a first image supporting member that supports a first static latent image to develop the first static latent image, said first developing portion further includes a first layer regulating member arranged to contact with a surface of the first developer supporting member and regulate a layer of the first developer, said second developing portion includes a second developer supporting member for supplying the second developer to a second image supporting member that supports a second static latent image to develop the second static latent image, said second developing portion further includes a second layer regulating member arranged to contact with a surface of the second developer supporting member and regulate a layer of the second developer, and said first layer regulating member is configured to apply a pressure to the first developer supporting member smaller than that of the second layer regulating member applied to the second developer supporting member.

2. The developing device according to claim 1, wherein said first layer regulating member includes a first fixing end portion on one end thereof and a first free end portion on the other end thereof.

3. The developing device according to claim 2, wherein said first layer regulating member includes a first contact portion for contacting the first developer supporting member on a side of the first free end portion.

4. The developing device according to claim 2, wherein said first layer regulating member is formed in a first bent shape, and said first layer regulating member includes a first bending portion formed between the first fixing end portion and the first free end portion, a first edge portion formed as a first bent portion, and a first bent piece extending toward a distal end portion from the first edge portion.

5. The developing device according to claim 4, wherein said first edge portion is configured to contact with the first developer supporting member.

6. The developing device according to claim 4, wherein said first layer regulating member is configured to apply the pressure to the first developer supporting member that is adjustable through changing a deformation amount generated between the first fixing end portion and the first free end portion.

7. The developing device according to claim 4, wherein said first layer regulating member is configured to apply the pressure to the first developer supporting member that is adjustable through changing a deformation amount smaller than that of the second layer regulating member.

8. The developing device according to claim 2, wherein said first layer regulating member is configured to contact with the first developer supporting member at a first contact portion thereof having a contact area smaller than that of the second layer regulating member contacting with the second developer supporting member.

9. The developing device according to claim 8, wherein said first layer regulating member is formed in a first bent shape, said first layer regulating member includes a first bending portion formed between the first fixing end portion and the first free end portion, a first edge portion formed as a first bent portion, and a first bent piece extending toward a distal end portion from the first edge portion, said second layer regulating member includes a second fixing end portion on one end thereof and a second free end portion on the other end thereof, said second layer regulating member is formed in a second bent shape, and said second layer regulating member includes a second bending portion formed between the second fixing end portion and the second free end portion, a second edge portion formed as a second bent portion, and a second bent piece extending toward a distal end portion from the second edge portion.

10. The developing device according to claim 9, wherein said first layer regulating member is configured to contact with the first developer supporting member at the first edge portion or the first bending portion.

11. The developing device according to claim 9, wherein said first layer regulating member is configured to contact with the first developer supporting member at the first bending portion, and said second layer regulating member is configured to contact with the second developer supporting member at the second edge portion thereof.

12. The developing device according to claim 1, wherein said first layer regulating member is configured to apply a linear pressure per unit length to the first developer supporting member smaller than that of the second layer regulating member applied to the second developer supporting member.

13. The developing device according to claim 1, wherein said first developing portion is configured to retain the first developer containing the metal oxide including a white colorant agent.

14. The developing device according to claim 1, wherein said first layer regulating member is formed of a metal plate.

* * * * *